US008602494B2

(12) United States Patent
Cvek

(10) Patent No.: US 8,602,494 B2
(45) Date of Patent: Dec. 10, 2013

(54) PIVOTING TASK CHAIR

(76) Inventor: Sava Cvek, Jamaica Plain, MA (US)

( * ) Notice: Subject to any disclaimer, the term of this patent is extended or adjusted under 35 U.S.C. 154(b) by 322 days.

(21) Appl. No.: 13/049,893

(22) Filed: Mar. 16, 2011

(65) Prior Publication Data

US 2012/0062005 A1 Mar. 15, 2012

Related U.S. Application Data

(60) Provisional application No. 61/314,579, filed on Mar. 16, 2010.

(51) Int. Cl.
*A47C 1/024* (2006.01)
*A47C 3/00* (2006.01)

(52) U.S. Cl.
USPC ..... 297/301.1; 297/284.7

(58) Field of Classification Search
USPC ..... 297/284.7, 301.1, 301.3, 301.4, 452.27, 297/452.56
See application file for complete search history.

(56) References Cited

U.S. PATENT DOCUMENTS 2,018,825 A * 10/1935 Wood ..... 297/301.4
2,838,095 A * 6/1958 Deaton ..... 297/301.4
2,901,027 A * 8/1959 Dickson ..... 297/301.7
3,741,607 A * 6/1973 Cramer ..... 297/303.5
6,199,252 B1 * 3/2001 Masters et al. ..... 29/91.1
6,575,530 B1 * 6/2003 Fischer et al. ..... 297/284.4
6,942,300 B2 * 9/2005 Numa et al. ..... 297/452.56
7,066,537 B2 * 6/2006 Coffield et al. ..... 297/284.4
7,517,024 B2 * 4/2009 Cvek ..... 297/452.13
7,530,640 B2 * 5/2009 Walters et al. ..... 297/440.22
7,731,295 B2 * 6/2010 Lin ..... 297/452.56
7,806,478 B1 * 10/2010 Cvek ..... 297/300.1
7,878,590 B1 * 2/2011 Bilak et al. ..... 297/284.2
2005/0052061 A1 * 3/2005 Deimen et al. ..... 297/301.1
2005/0062323 A1 * 3/2005 Dicks ..... 297/284.4

* cited by examiner

*Primary Examiner* — Philip Gabler
(74) *Attorney, Agent, or Firm* — O'Connell Law Firm; Thomas P. O'Connell

(57) ABSTRACT

A task chair with a chair base, a pivoting mechanism housing supported by the chair base, a non-pivoting seat bottom, and a pivoting seat back coupled to the pivoting mechanism housing. The seat bottom can have a rigid seat pan that underlies a flexible seat insert and a seat cushion. The seat pan, the seat insert, and the seat cushion can be matingly engaged. A seat back frame can retain a panel of elastomeric material, and lumbar supports can be slidably retained by the seat back frame. The lumbar supports can be flexible to adjust to contoured support rails and can be fixed at selected locations along the rails. The lumbar supports can have non-symmetrical, contoured surfaces and shapes and can be nondestructively removable and exchangeable. Adjustable arm structures with upper and lower arm members can be raised and lowered by operation of an actuation trigger.

20 Claims, 17 Drawing Sheets

PIVOTING TASK CHAIR

FIELD OF THE INVENTION

The present invention relates generally to task chairs. More particularly, disclosed herein is a task chair with advantageous pivoting characteristics and improved seat bottom, lumbar support, and arm support constructions.

BACKGROUND OF THE INVENTION

Innumerable task chair constructions have been disclosed by the prior art. In a typical task chair construction, a mobile chair base retains a seat bottom and a seat back. The seat back may be pivotally retained, or both the seat bottom and the seat back may pivot, potentially in what has been argued to be an ergonomically-sound, synchronized movement.

However, under many prior art structures where both the seat bottom and the seat back pivot, the seat occupant sinks downwardly as he or she pivots backwardly. Other pivoting chair constructions provide a seat bottom that rises in relation to the seat back as the seat back is pivoted backwardly. With that, the seat occupant is given the sensation that the seat back is driving the occupant and his or her clothing contacting the seat back toward the seat bottom. In still other pivoting chairs, the seat back seems to apply a lifting force to the back of the seat occupant in relation to the seat bottom. Each construction is less than ideal for most seat occupants.

Based on his knowledge of these deficiencies of the prior art, the present inventor has appreciated that a pivoting task chair providing enhanced, ergonomically sound support to a seat occupant, including during pivoting, would represent a useful advance in the art. The present inventor has further appreciated that a pivoting task chair providing advances in relation to the seat bottom and its attachment to the body of the task chair and in relation to the lumbar and arm support constructions would additionally contribute usefully to the state of the art.

SUMMARY OF THE INVENTION

The present invention is thus founded on the basic object of providing a pivoting task chair that provides enhanced, ergonomically sound support to a seat occupant, including during pivoting. A more particular object of embodiments of the invention is to provide a pivoting task chair where a seat back can pivot in relation to a non-pivoting seat bottom while giving the seat occupant comfortable ergonomic support without the perception that he or she is sinking and without a feeling that the seat back, the lumbar support provided thereby, and back of the seat occupant are being raised or lowered relative to the seat bottom.

In certain embodiments, the invention has the additional or alternative object of providing an improved seat bottom construction for pivoting task chairs. Embodiments of the invention have the further objects of providing adjustable lumbar structures and, potentially, adjustable arm support structures.

These and further objects and advantages of the present invention will become obvious not only to one who reviews the present specification and drawings but also to those who have an opportunity to experience an embodiment of the pivoting task chair disclosed herein. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth the aforementioned objects, one embodiment of the pivoting task chair is founded on a chair base that supports a pivoting mechanism housing. A pivoting mechanism is retained by the pivoting mechanism housing, and a seat bottom is secured to the pivoting mechanism housing. The seat bottom in this embodiment does not pivot in relation to the chair base. A seat back is pivotally coupled to the pivoting mechanism housing by the pivoting mechanism to pivot about a pivot axis in relation to the pivoting mechanism housing and relative to the seat bottom. With this, the pivoting mechanism provides resilient resistance to a pivoting of the seat back. A distance B from a given point on the seat back to a given point of support for a posterior of a seat occupant progressively decreases as the seat back is pivoted backwardly with a measurement $B_1$ taken at a first seat back pivoting position being greater than a measurement $B_2$ at a second, increased seat back pivoting position and the measurement $B_2$ being greater than a measurement $B_3$ at a third, further increased seat back pivoting position.

Particular embodiments of the task chair can include left and right arm supports with upper ends fixed to the seat back, each at a point of support, and lower ends pivotally coupled to the pivoting mechanism, each at a pivot axis coincident with the pivot axis of the seat back to pivot with the seat back. A distance A from the point of support of each arm relative to the seat back to the pivot axis progressively decreases as the seat back is pivoted backwardly with a measurement $A_1$ taken at a first seat back pivoting position being greater than a measurement $A_2$ at a second, increased seat back pivoting position and the measurement $A_2$ being greater than a measurement $A_3$ at a third, further increased seat back pivoting position.

The chair base can have a central cylinder. A piston arrangement can be included with a base portion retained in the central cylinder of the chair base and a projecting portion that extends beyond the central cylinder of the chair base. A protective encasing ring can be received around the projecting portion of the piston of the piston arrangement to sit atop the central cylinder of the chair base to protect the base portion of the piston arrangement. To render the task chair mobile, a plurality of casters can be retained relative to the chair base.

The seat bottom can be formed with a rigid seat pan that underlies a flexible seat insert, and a seat cushion can be secured to overlie the seat insert and the seat pan. The seat insert has a depression pattern in the bottom surface thereof corresponding in shape and contour to an upper surface of the seat pan whereby the seat insert and the seat pan are matingly engaged. Likewise, the seat cushion has a depression pattern in the bottom surface thereof corresponding in shape and contour to an upper surface of the seat insert whereby the seat cushion and the seat insert are matingly engaged.

To permit a flexing of the seat pan, a plurality of flexing slots can be formed adjacent to an anterior edge thereof. In one embodiment, the flexing slots are disposed in a first, inboard line of abbreviated slots and a second, outboard line of relatively elongated slots communicating adjacent to and generally evenly spaced from the anterior edge of the seat pan. To permit further flexing of the seat bottom, the seat insert can have an anterior edge portion that extends beyond an anterior edge of the seat pan.

Under certain constructions, the seat back comprises a seat back frame and a panel of elastomeric material retained relative to the frame wherein the panel of elastomeric material has a first side for supporting a seat occupant and a second, opposite side and further comprising left and right lumbar support members retained by the seat back frame to the second side of the panel of elastomeric material. The left and right lumbar support members can be slidably retained relative to the seat back frame, such as by contoured left and right lumbar support rails, whereby a location of lumbar support can be adjusted. For example, each lumbar support can include a plurality of flexible fingers disposed in series along the edge thereof, and the flexible fingers can have C-channels formed therein for slidably receiving the respective left and right lumbar support rails.

Means can be provided for fixing the lumbar supports in selected locations along the rails. In one embodiment of the invention, that means can take the form of a tooth that projects from each lumbar support in combination with a longitudinally aligned series of indentations retained relative to the seat back frame. Moreover, the lumbar support members can have non-symmetrical, contoured surfaces and shapes. They can be nondestructively removable and exchangeable. With that, the lumbar support members can be removed, rotated by 180 degrees, and oppositely disposed to provide varied lumbar support.

Still further, left and right adjustable arm structures can be retained to left and right sides of the seat bottom. Each adjustable arm structure has an upper arm member with a lower cylindrical portion comprising a sleeve, a lower arm member slidably received into the cylindrical portion of the upper arm member, and an actuation trigger retained adjacent to an upper end of the upper arm member. Actuation of the actuation trigger permits a selective raising and lowering of the upper arm member relative to the lower arm member.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

Figure 1:
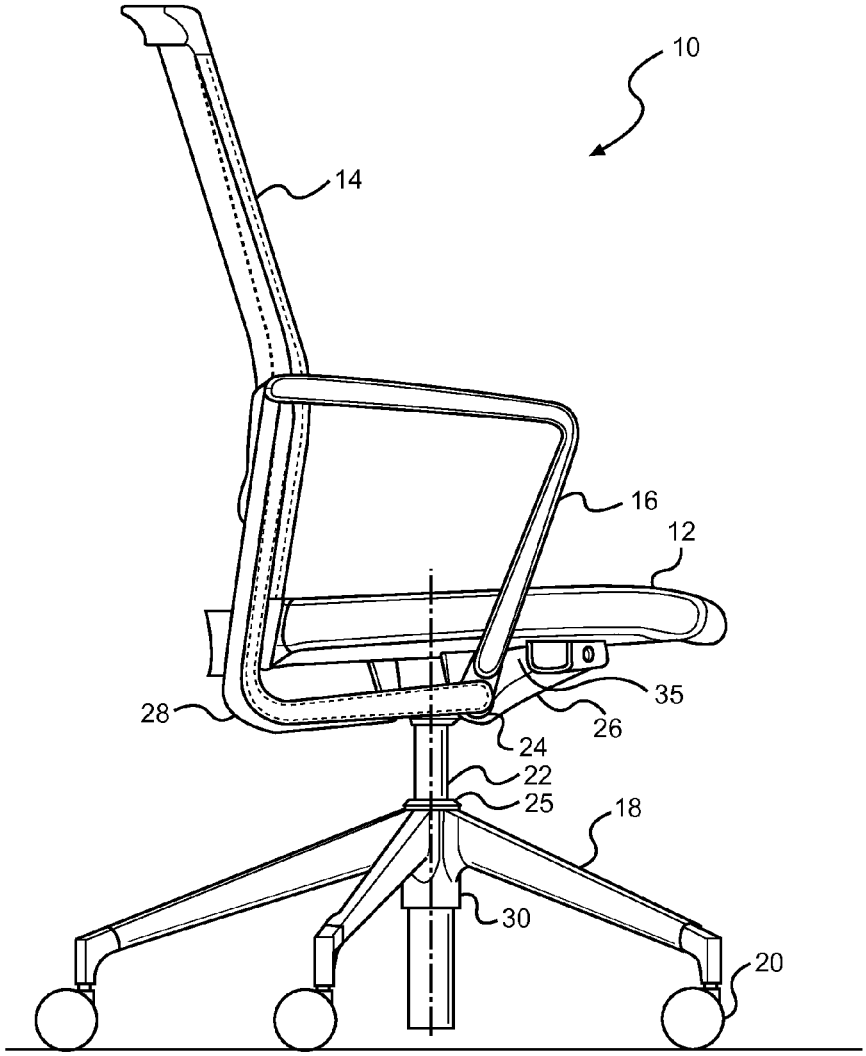
FIG. 1 is a view in side elevation of a pivoting task chair according to the present invention.

The pivoting task chair disclosed herein is subject to a wide variety of embodiments. However, to ensure that one skilled in the art will be able to understand and, in appropriate cases, practice the present invention, certain preferred embodiments of the broader invention revealed herein are described below and shown in the accompanying drawing figures. Therefore, before any particular embodiment of the invention is explained in detail, it must be made clear that the following details of construction and illustrations of inventive concepts are mere examples of the many possible manifestations of the invention.

Turning more particularly to the drawings, a pivoting task chair pursuant to the present invention is indicated generally at 10 in, for example, FIGS. 1 and 2A through 2C. The pivoting task chair 10 has a pivoting mechanism housing 26 that is supported relative to a chair base 18 by an extendable and retractable piston arrangement 22. A plurality of casters 20 are retained relative to the chair base 18 to rotate about vertical caster axes and horizontal wheel axes to render the pivoting task chair 10 mobile.

A seat bottom 12 is secured to the pivoting mechanism housing 26 as will be described further hereinbelow. A seat back 14 is pivotally coupled to the pivoting mechanism housing 26 by a back support bracket 28 to pivot about a pivot axis 24 in relation to the pivoting mechanism housing 26 and relative to the seat bottom 12. In this embodiment, left and right arm supports 16 have upper ends fixed to the seat back 14 and lower ends pivotally retained at the pivot axis 24 to pivot with the seat back 14.

The base of the piston arrangement 22 is entirely retained in a central cylinder 30 of the chair base 18. A protective encasing ring 25 is received around the projecting portion of the piston of the piston arrangement 22 to sit atop the central cylinder 30 of the chair base 18. With this, the base of the piston arrangement 22 is protected and encased in an aesthetically pleasing manner.

A pivoting mechanism 35 is retained within the pivoting mechanism housing 26 to provide resilient resistance to the pivoting of the seat back 14. Except as the invention may be expressly limited, the pivoting mechanism 35 can be of any effective type. As is known to the art, the pivoting resistance can be adjustable or fixed at a given level of resistance.

Under this arrangement, the height of the seat bottom 12, the seat back 14, and the arm supports 16 can be adjusted simultaneously by an actuation of the piston arrangement 22. The seat back 14 and the arm supports 16 can be selectively reclined relative to the non-pivoting seat bottom 12 when desired by the seat occupant. Moreover, the task chair 10 in general can be rolled over a given support surface by use of the casters 20.

Figure 2B:
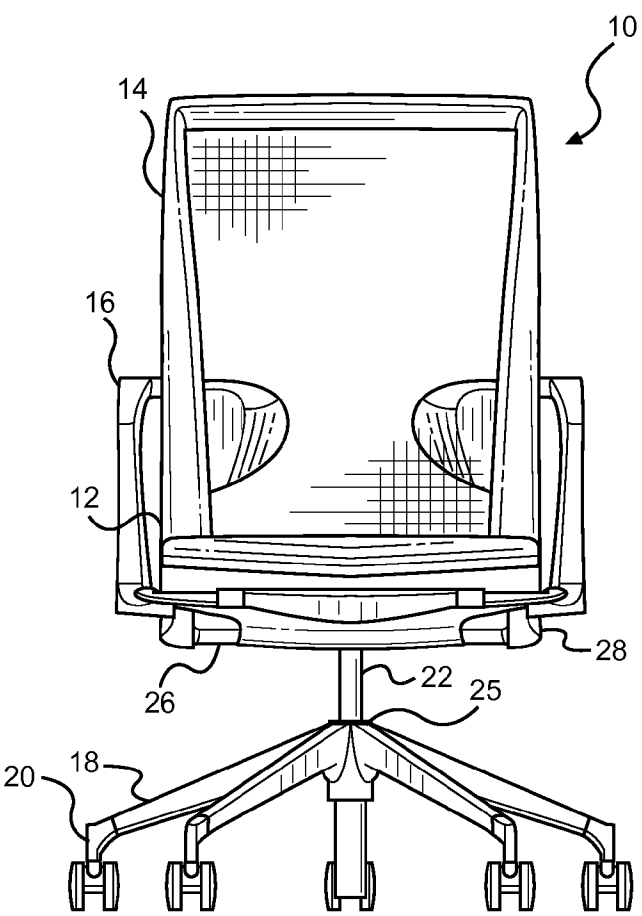
FIG. 2B is a view in front elevation of the task chair of FIG. 1.
Figure 2A:
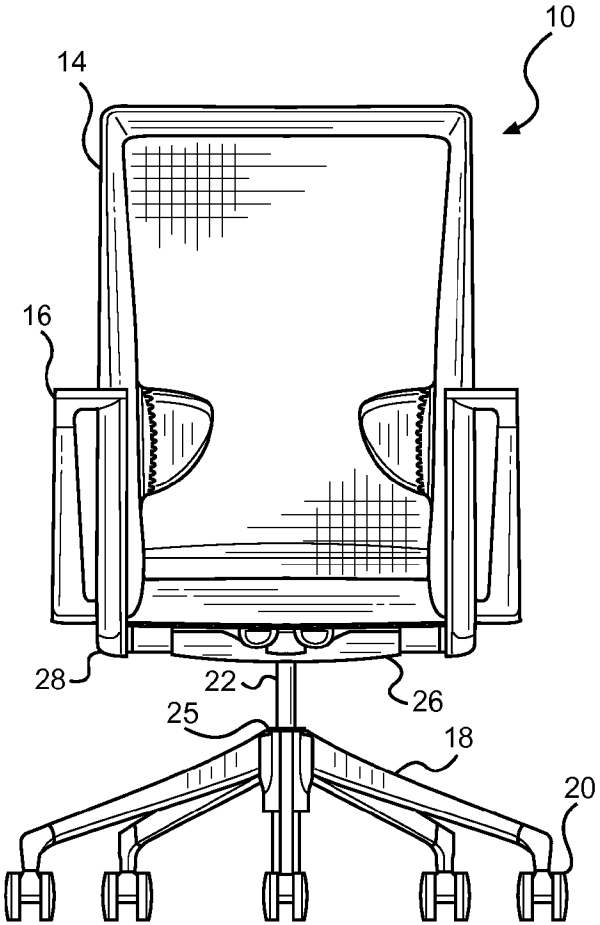
FIG. 2A is a view in rear elevation of the task chair of FIG. 1.
Figure 2D:
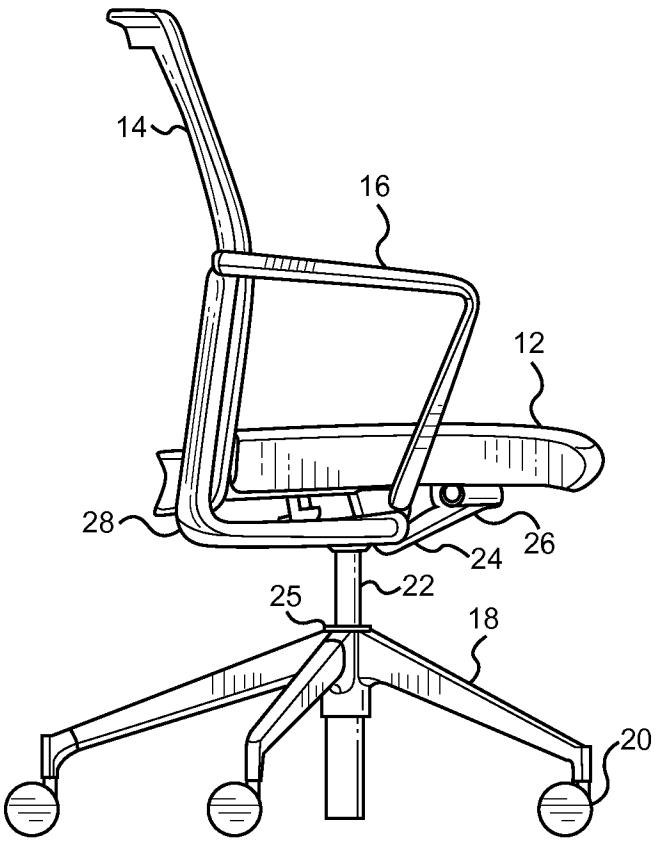
FIG. 2D is a view in side elevation of an alternative task chair as disclosed herein.
Figure 2C:
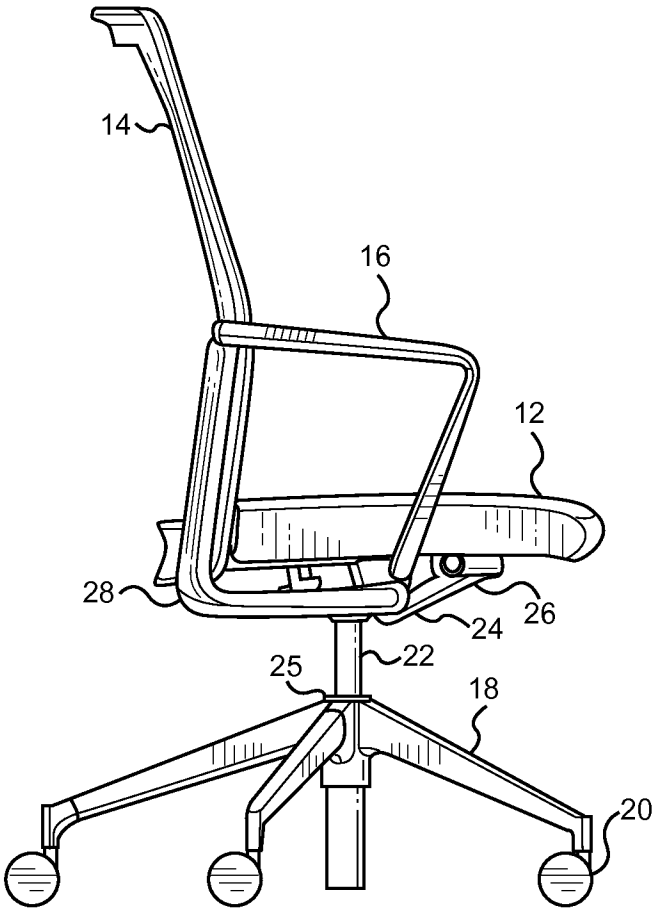
FIG. 2C is a further view in side elevation of the task chair of FIG. 1.
Figure 2F:
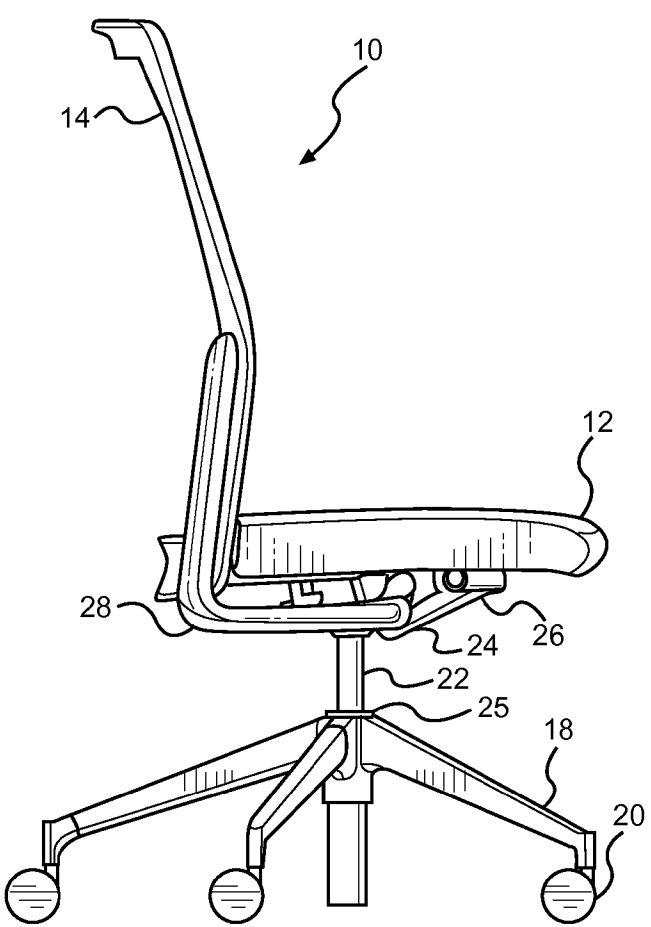
FIG. 2F is a view in side elevation of another task chair.
Figure 2E:
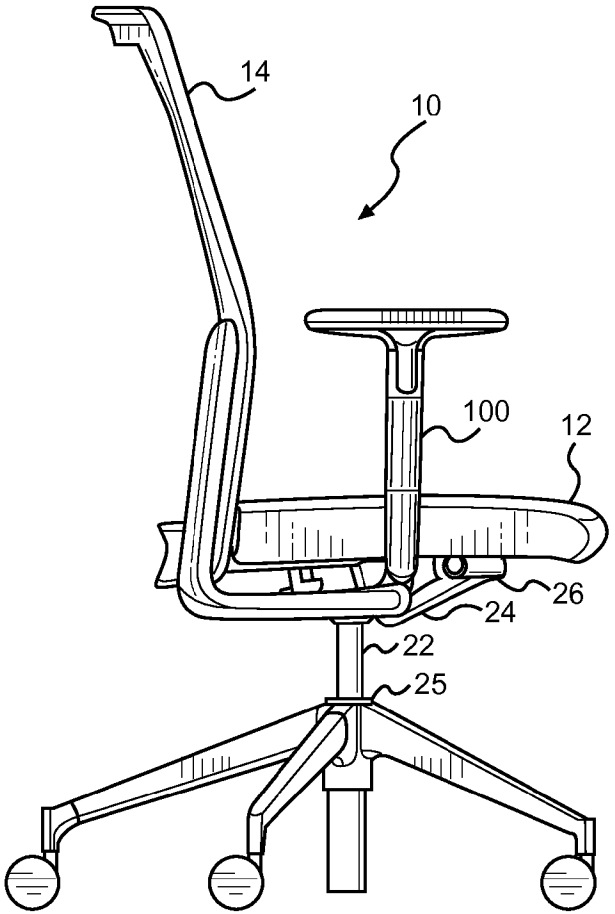
FIG. 2E is a view in side elevation of a further task chair pursuant to the invention.

The components of the task chair 10 can vary within the scope of the invention. For example, as shown in FIG. 2D, embodiments of the task chair 10 are contemplated with an abbreviated seat back 14. Furthermore, task chairs 10 within the scope of the invention can have arm structures 100 that are adjustable in height as shown in FIG. 2E and as is described further hereinbelow. Still further, as FIG. 2F depicts, task chairs 10 pursuant to the invention could be armless.

The pivoting of the seat back 14 in relation to the non-pivoting of the seat bottom 12 and the location of the pivot axis 24 in relation to the seat back 14 and the seat bottom 12 have been found to be ergonomically advantageous in relation even to the many pivoting arrangements disclosed by the prior art. Under many prior art structures where both the seat bottom and the seat back pivot, for example, the seat occupant sinks downwardly as he or she pivots backwardly. Other arrangements actually have a seat bottom that rises in relation to the seat back as the seat back is pivoted backwardly thereby giving the sensation that the seat back is driving the occupant and his or her clothing contacting the seat back toward the seat bottom. In still other arrangements, the pivoting seat back seems to apply a lifting force to the back of the seat occupant in relation to the seat bottom.

Figure 3:
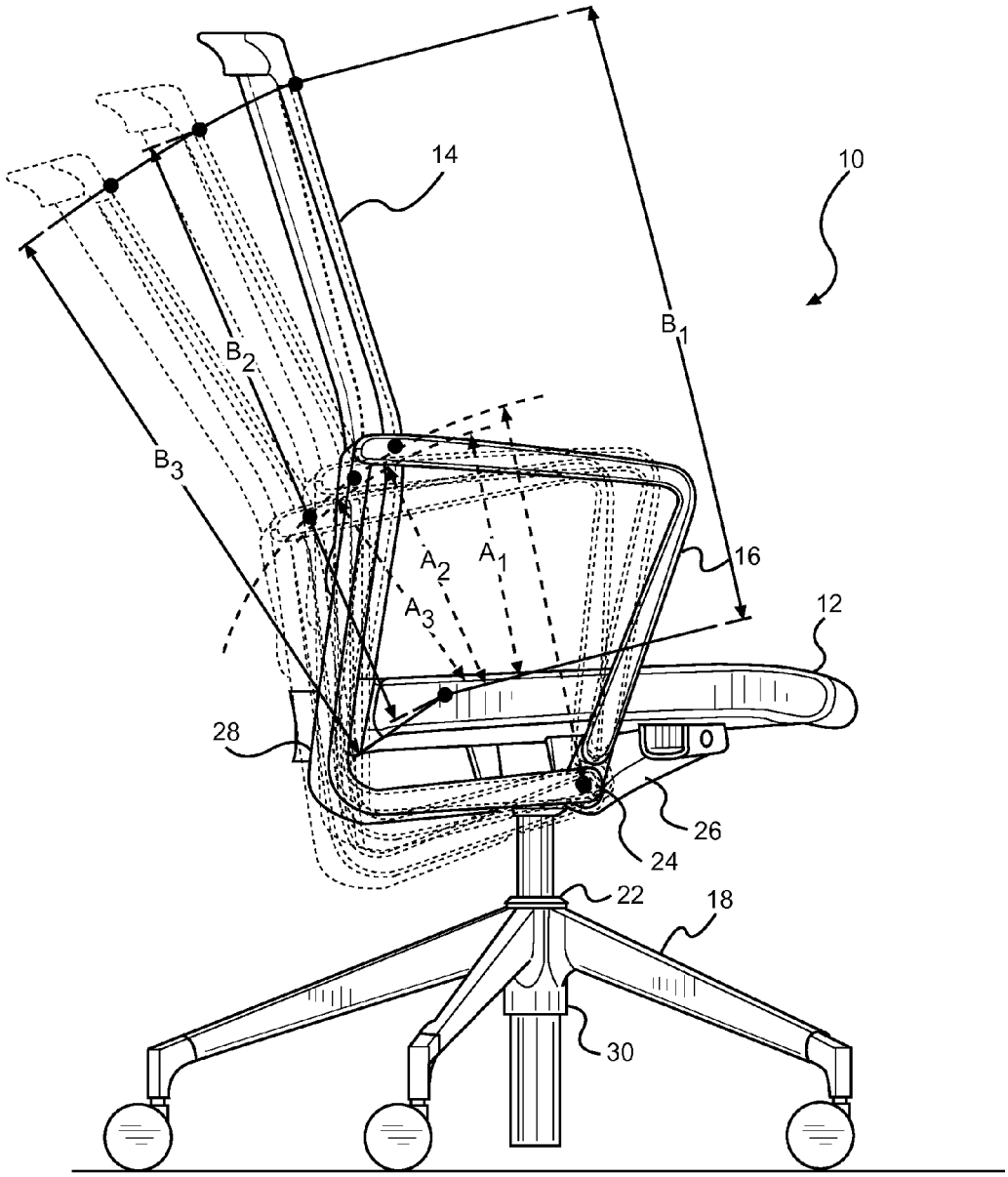
FIG. 3 is a view in side elevation of the task chair of FIG. 1 pivoted through a range of pivoting.

While the precise source of the advantages provided by the disclosed structure of the present invention may be analyzed in greater detail, a level of understanding of the benefits provided by the invention can be had with additional reference to FIG. 3. As configured, the pivoting of the seat back 14 about the pivot axis 24 in relation to the non-pivoting seat bottom 12 advantageously gives the seat occupant comfortable ergonomic support without the perception that he or she is sinking and without a feeling that the seat back 14, the lumbar support provided thereby, and back of the seat occupant are being raised or lowered relative to the seat bottom 12.

As shown in FIG. 3, the distance B from a point on the seat back 14 to the point of support for the posterior of the seat occupant and the distance A from the location that the arm support 16 meets the seat back 14 to the point of support for the posterior of the seat occupant progressively decrease as the seat back 14 is pivoted backwardly as is indicated by the progressive measurements $B_1$, which is greater than $B_2$, which is greater than $B_3$ and $A_1$, which is greater than $A_2$, which is greater than $A_3$. However, as the seat occupant's body reclines, the seat occupant's body undergoes a complex series of adjustments and relative pivots whereby the perception is of consistent support provided by the seat back 14 and the provided lumbar support.

Figure 12:
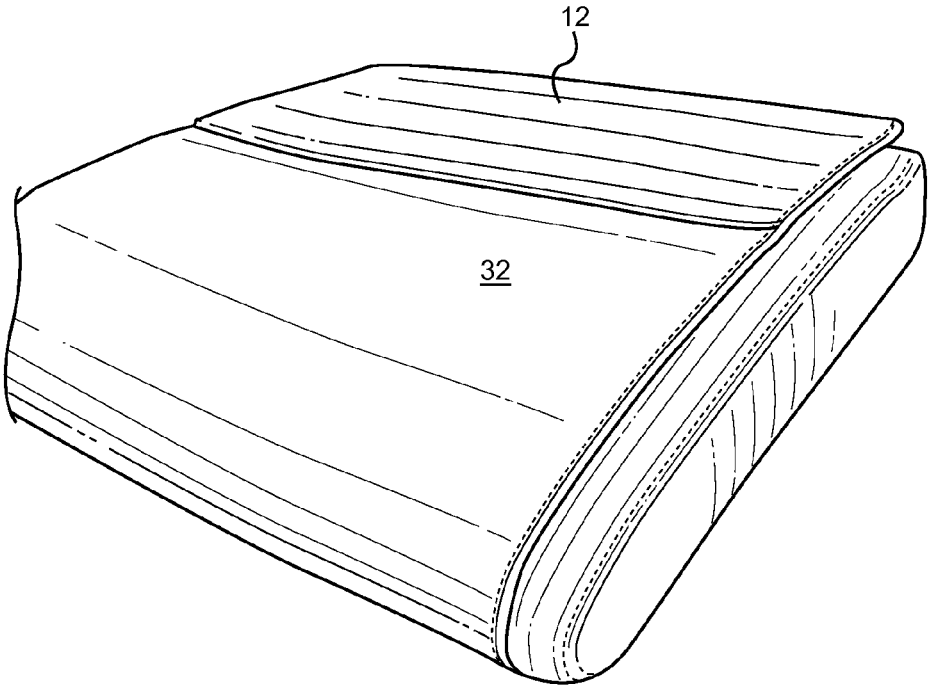
FIG. 12 is a frontal perspective view of an assembled seat bottom.
Figure 13:
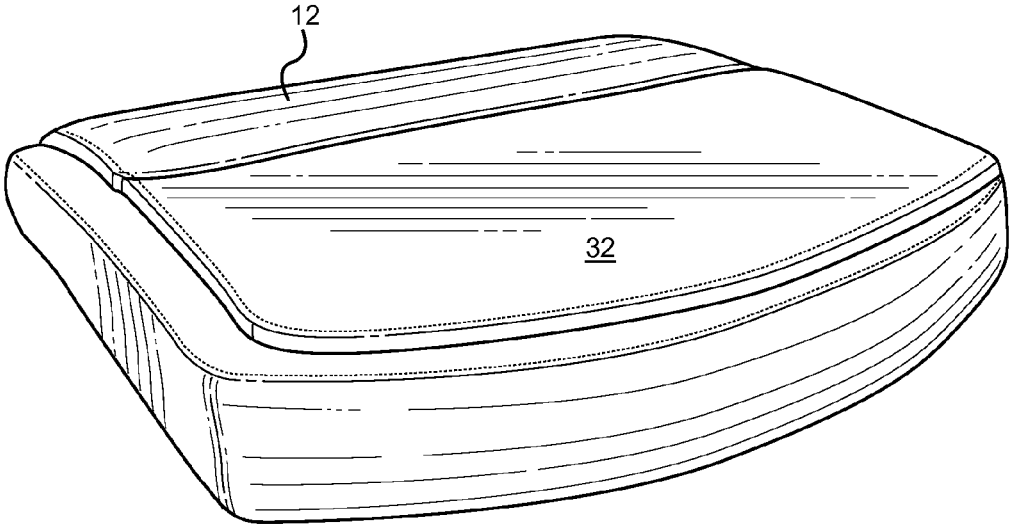
FIG. 13 is a rear perspective view of the seat bottom of FIG. 13.
Figure 15:
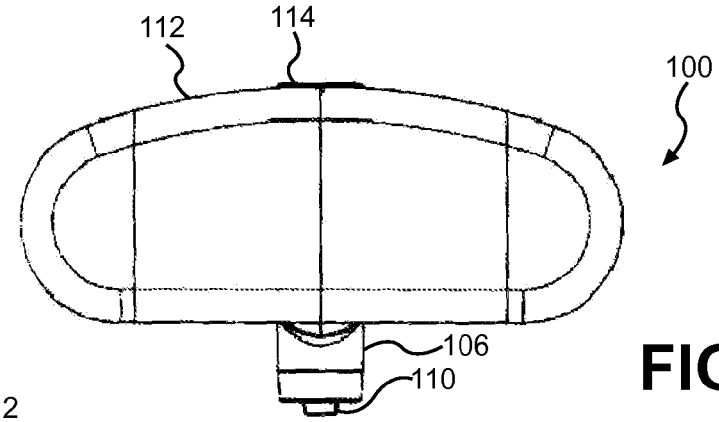
FIG. 15 is a top plan view of the adjustable arm of FIG. 14.
Figure 14:
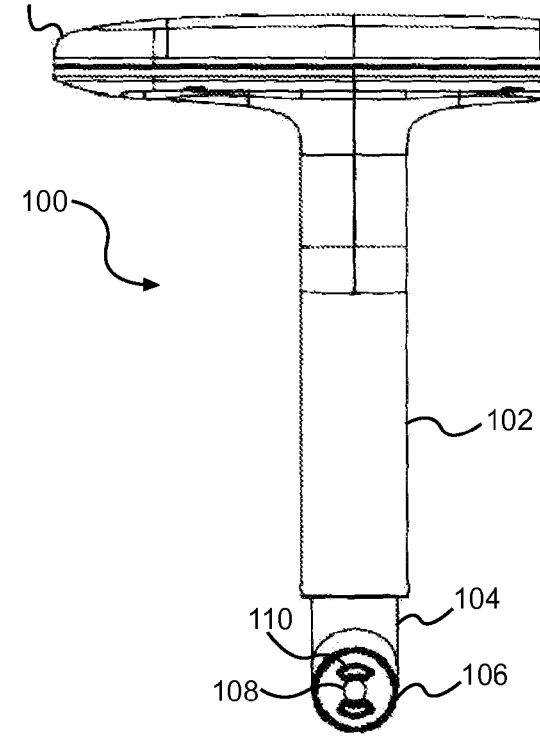
FIG. 14 is a view in side elevation of an adjustable arm according to the invention.
Figure 16:
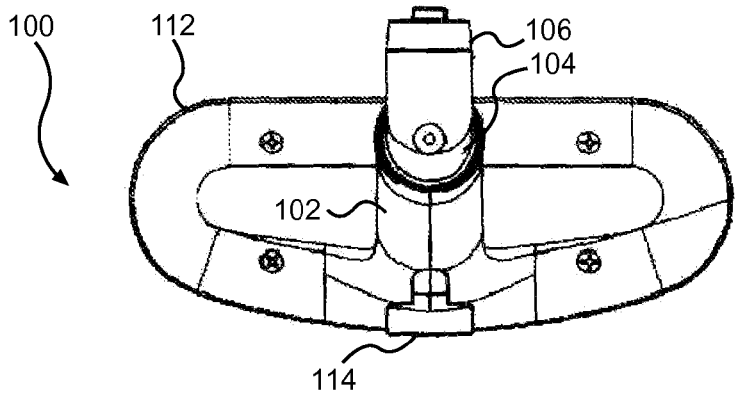
FIG. 16 is a bottom plan view of the adjustable arm of FIG. 14.
Figure 17:
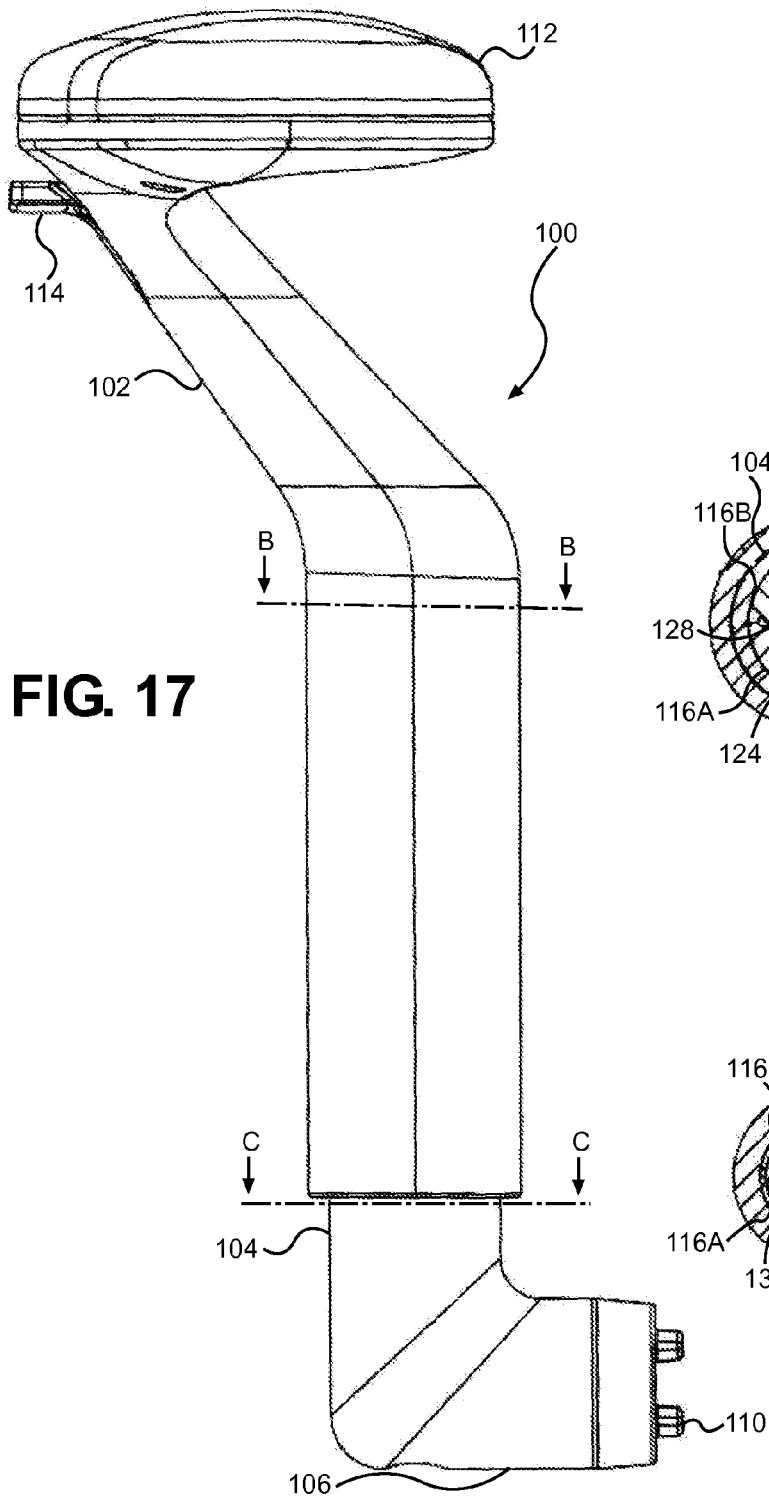
FIG. 17 is a view in front elevation of the adjustable arm of FIG. 14.

A better understanding of the seat bottom 12 can be had by combined reference to FIGS. 4A through 6. In this embodiment, the seat bottom 12 is founded on a rigid seat pan 38 that underlies a flexible seat insert 36. A cushion member 34, which can be foam or any other cushioning material or material combination, is secured to the seat insert 36 and the seat pan 38. One or more layers of upholstery 32 are applied over the cushion member 34. The seat pan 38 is formed form a rigid material, such as glass filled nylon in one potential embodiment, and the seat insert 36 is formed of a flexible material, such as polypropylene in one embodiment. When assembled, the seat bottom 12 can assume the finished appearance indicated, for example, in FIGS. 12 and 13.

The cushion 34 has a depression pattern 42 in the bottom surface thereof for matingly receiving the seat insert 36. The depression pattern 42 matches the shape and contour of the seat insert 36. Similarly, the flexible seat insert 36 has a depression pattern 44 in the bottom surface thereof for matingly receiving the correspondingly shaped and contoured seat pan 38. Fasteners 40 or other means can be employed for securing the seat pan 38 to the seat insert 36, the upholstery 32 to the cushion 34, and for otherwise securely coupling the upholstery 32, the cushion 34, the seat insert 36, and the seat pan 38 into a unit. The seat insert 36 has forward and rearward air passages 46, and the seat pan 38 has aligned forward and rearward air passages 48 for permitting the cushion 34 to be compressed and decompressed smoothly.

Figure 4A:
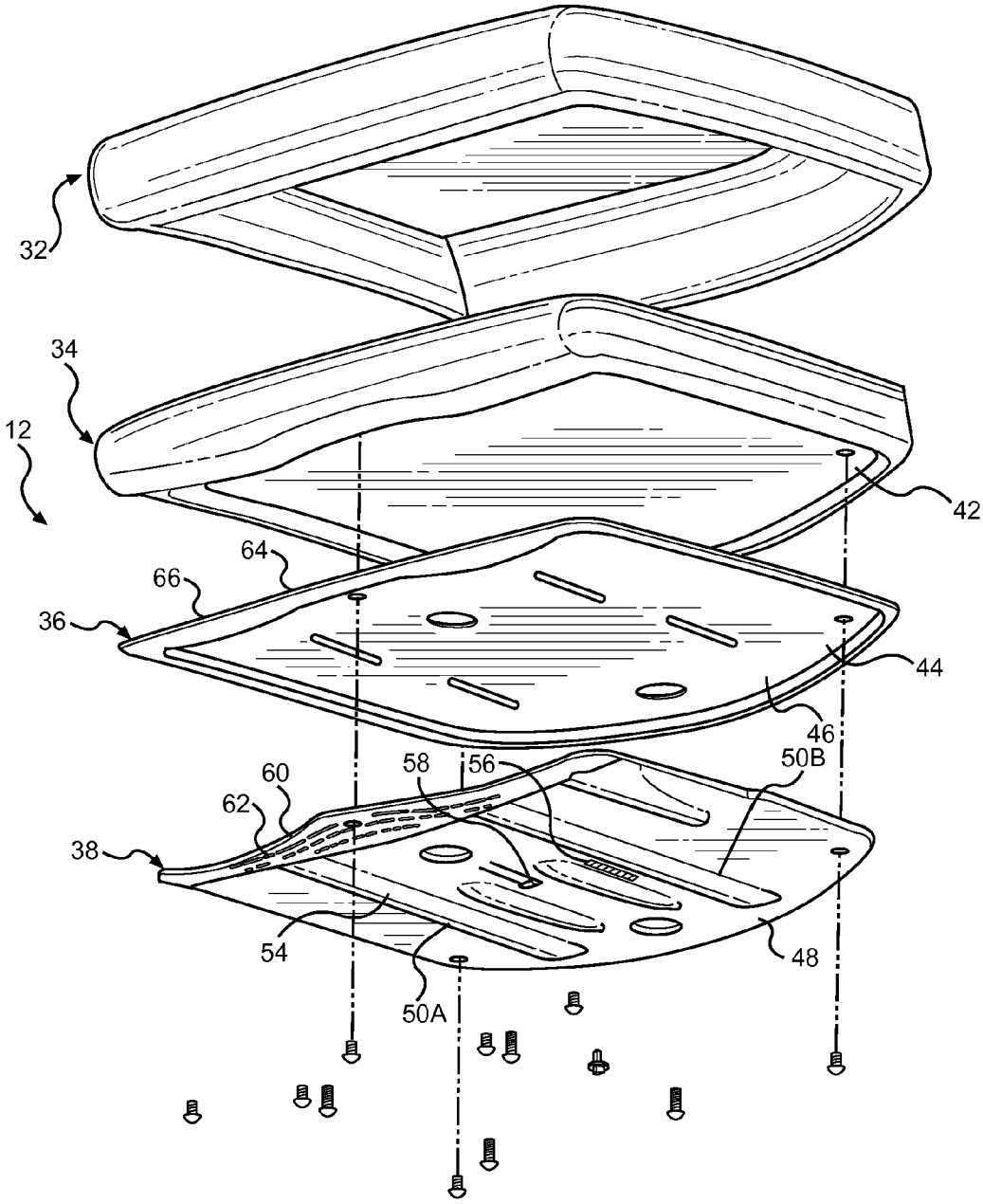
FIG. 4A is an exploded perspective view of a seat bottom as disclosed herein.
Figure 4B:
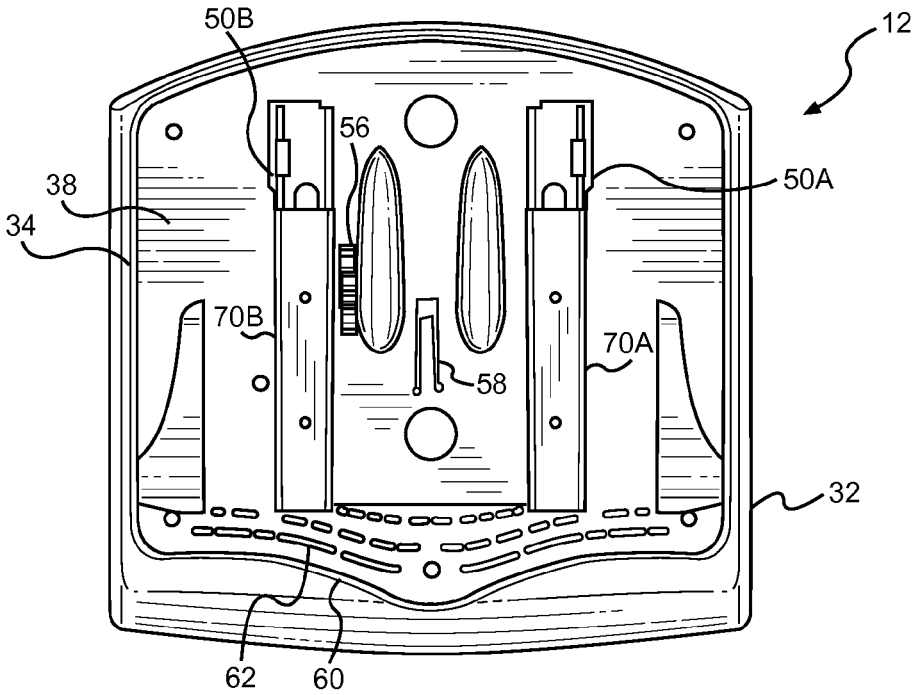
FIG. 4B is a bottom plan view of the assembled seat bottom of FIG. 4A.
Figure 4C:
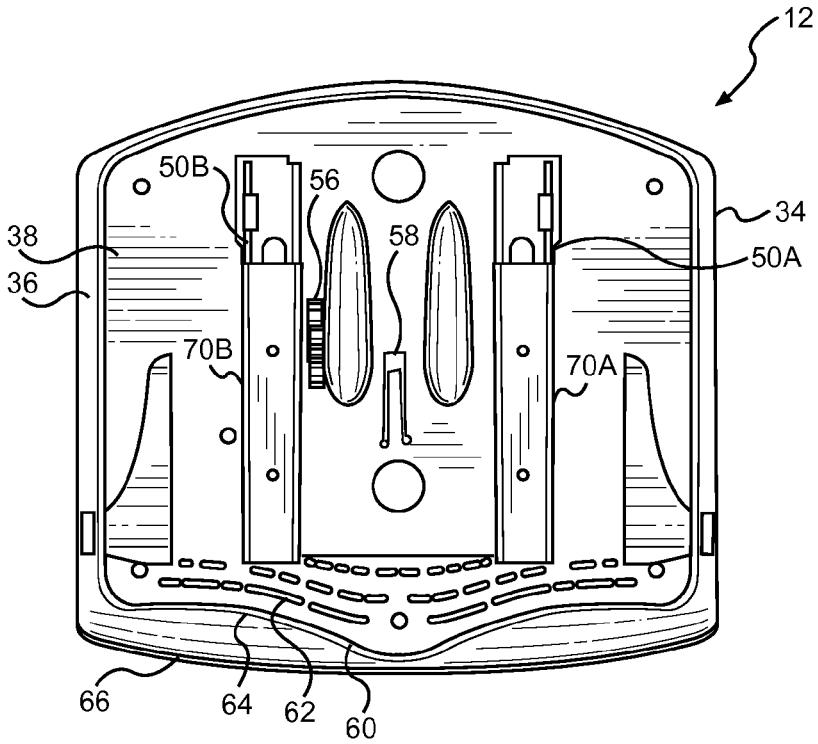
FIG. 4C is a bottom plan view of the assembled seat bottom of FIG. 4A devoid of upholstery.
Figure 5:
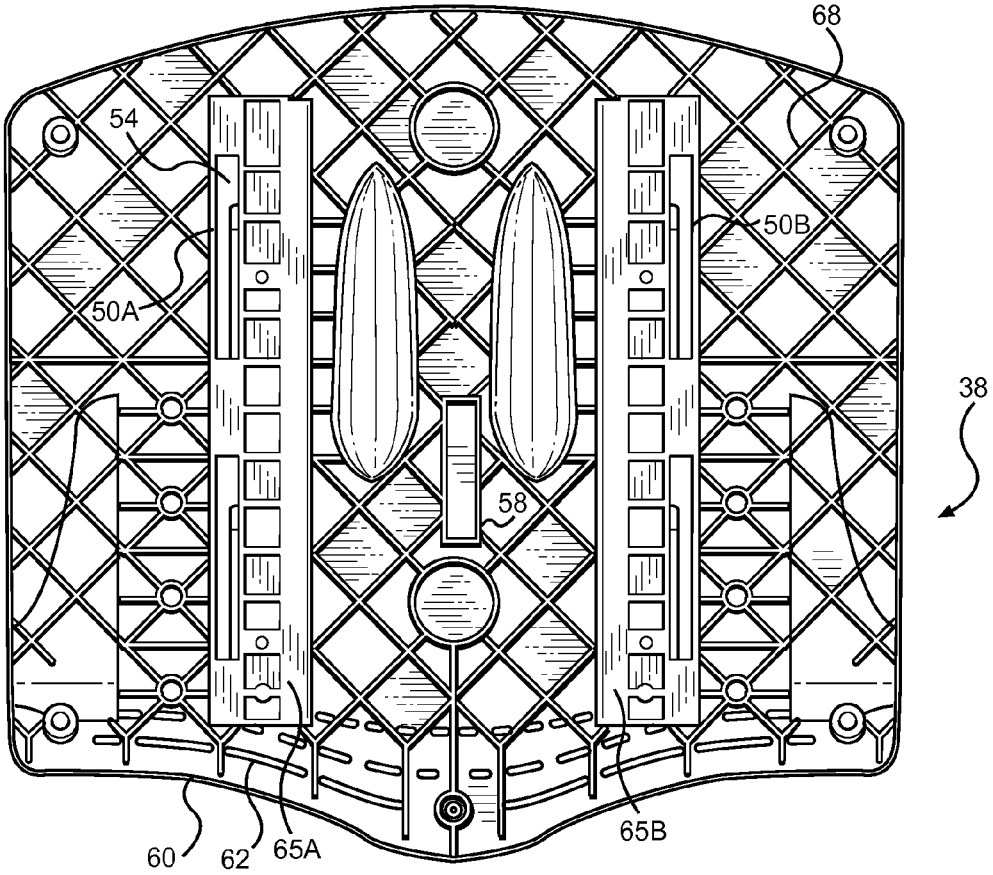
FIG. 5 is a top plan view of a seat pan.

As best perceived by reference to FIG. 4C, the seat pan 38 has an ergonomically shaped anterior edge 60 with a protruding central portion and inwardly curved left and right lateral portions corresponding to the location of a seat occupant's legs. Moreover, a plurality of flexing slots 62 are formed, such as by molding, cutting, or any other method, adjacent to the anterior edge 60 for providing a degree of flexibility to the otherwise rigid seat pan 38. As shown, the flexing slots 62 are disposed in a first, inboard line of abbreviated slots 62 and a second, outboard line of relatively elongated slots 62 communicating adjacent to and generally evenly spaced from the anterior edge 60. Additionally, as shown in FIG. 5, the seat pan 38 has a crossing pattern of rigidifying ribs 68 that enhance the rigidity of the seat pan 38. The ribs 68 taper toward the anterior edge 60 of the seat pan 38 for cooperating with the slots 62 to permit a flexing of the anterior portion of the seat pan 38.

The depression pattern 44 in the flexible seat insert 36 has an anterior edge 64 that corresponds to the shape of the anterior edge 60 of the seat pan 38, and the seat insert 36 has an anterior edge portion 66 that extends beyond the anterior edge 60 of the seat pan 38 to provide a smooth, flexible forward edge to the combined structure presented by the seat insert 36 and the seat pan 38. With this, the seat bottom 12 demonstrates sufficient rigidity for proper occupant support while providing anterior flexibility to give comfortable support to the legs of the seat occupant.

Left and right channels 50A and 50B with parallel slots are longitudinally disposed through the seat pan 38. The channels 50A and 50B can be continuous or separated into sections. Each channel 50A and 50B has first and second inwardly extending lateral notches 54. Additionally, the underside of the seat pan 38 has a longitudinal-spaced series of locking notches 56, and a barbed, longitudinally aligned locking finger 58.

Figure 6:
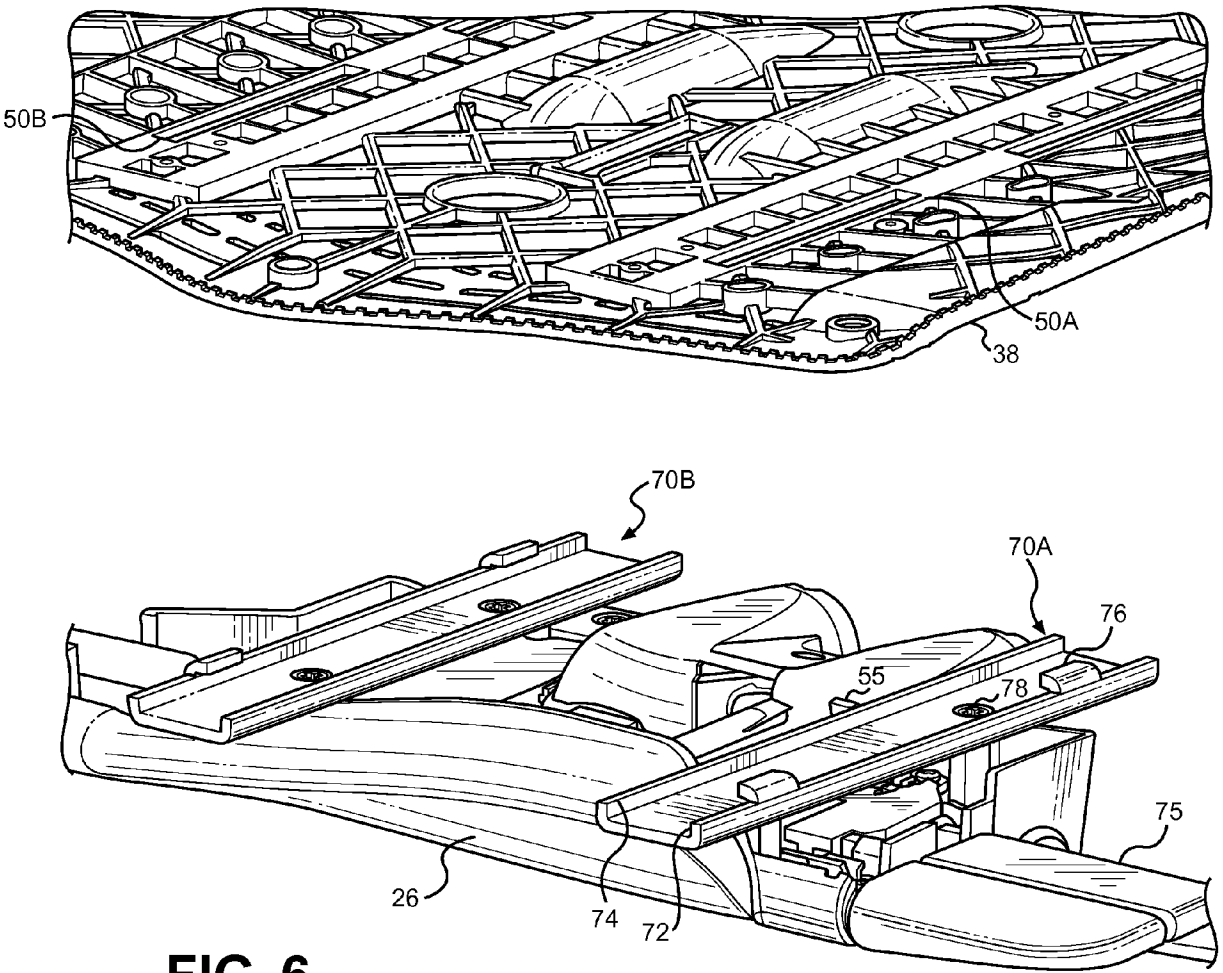
FIG. 6 is a partially exploded perspective view of a seat pan during assembly with a pivoting mechanism housing.

The seat pan 38 and the seat bottom 12 in general can be engaged with the pivoting mechanism housing 26 as is suggested by FIGS. 4B, 4C and 6. In FIG. 6, left and right slide rails 70A and 70B are fastened to the pivoting mechanism housing 26 in a longitudinal orientation by fasteners 78. Each slide rail 70A and 70B has an inboard rail portion 74 for being slidably received into the corresponding slots 65A and 65B parallel to the left and right channels 50A and 50B and an outboard rail portion 72 for being received through the corresponding channel 50A and 50B. First and second inwardly disposed lateral portions 76 extend inboard from each of the outboard rail portions 72. The lateral portions 76 are spaced equally in correspondence to the spacing of the notches 54 in the channels 50A and 50B.

With this, the seat pan 38 can be aligned with the slide rails 50A and 50B with the lateral portions 76 aligned with the notches 54 to have the rails 72 and 74 received into the slots 65A and 65B and the channels 50A and 50B. Locking tooth 55 can be retracted by actuation of a lever handle 75 thereby to permit the seat pan 38 and the seat bottom 12 in general to be slid longitudinally until the notches 54 of the channels 50A and 50B are not aligned with the lateral portions 76 of each slide rail 70A and 70B. Then, the locking tooth 55 can be extended to engage one of the locking notches 56, again by actuation of the lever handle 75, thereby to fix the seat pan 38 and the seat bottom 12 against longitudinal movement relative to the pivoting mechanism housing 26. When adjustment is desired, the lever handle 75 can be selectively actuated.

When necessary, the locking finger 58 of the seat bottom 12 can engage the anterior edge of the pivoting mechanism housing 26 or another structure of the pivoting mechanism housing 26 to prevent the seat pan 38 and the seat bottom 12 from inadvertently overextending to become dislodged from the pivoting mechanism housing 26. When the seat bottom 12 is to be removed from the pivoting mechanism housing 36, the lever handle 75 can be actuated to disengage the locking tooth 55 from the locking notches 56 and the locking finger 58 can be depressed out of engagement with the pivoting mechanism housing 26. With this, removal and replacement of the seat bottom 12 can be accomplished without a need for tools or the removal of any fasteners.

Figure 8:
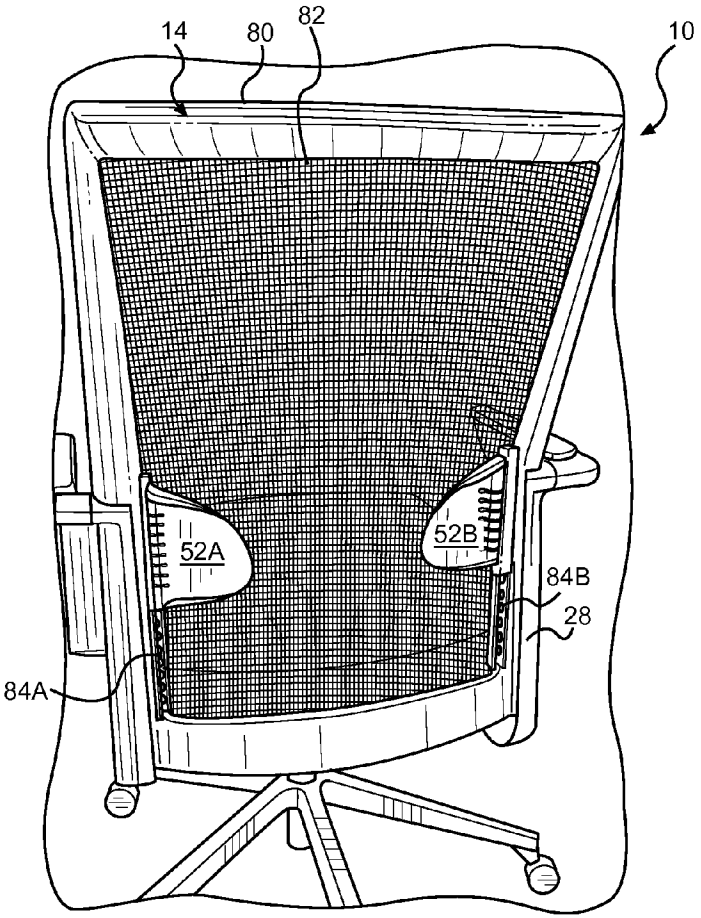
FIG. 8 is a view in rear elevation of the task chair of FIG. 7 with the lumbar support members retained in a second orientation.
Figure 7:
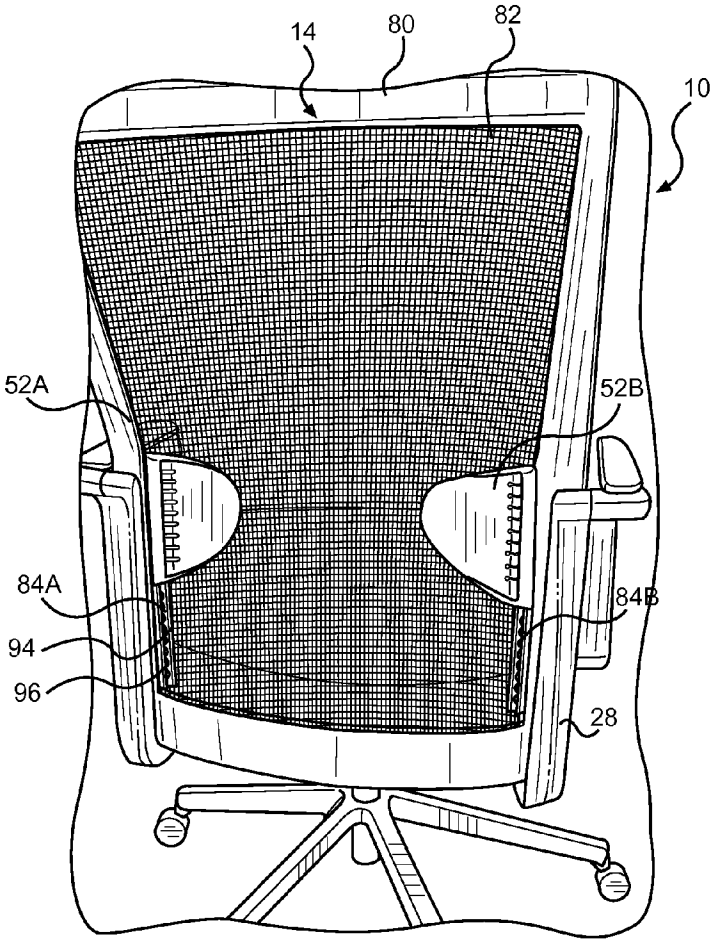
FIG. 7 is a view in rear elevation of a task chair with lumbar support members retained in a first orientation.
Figure 9:
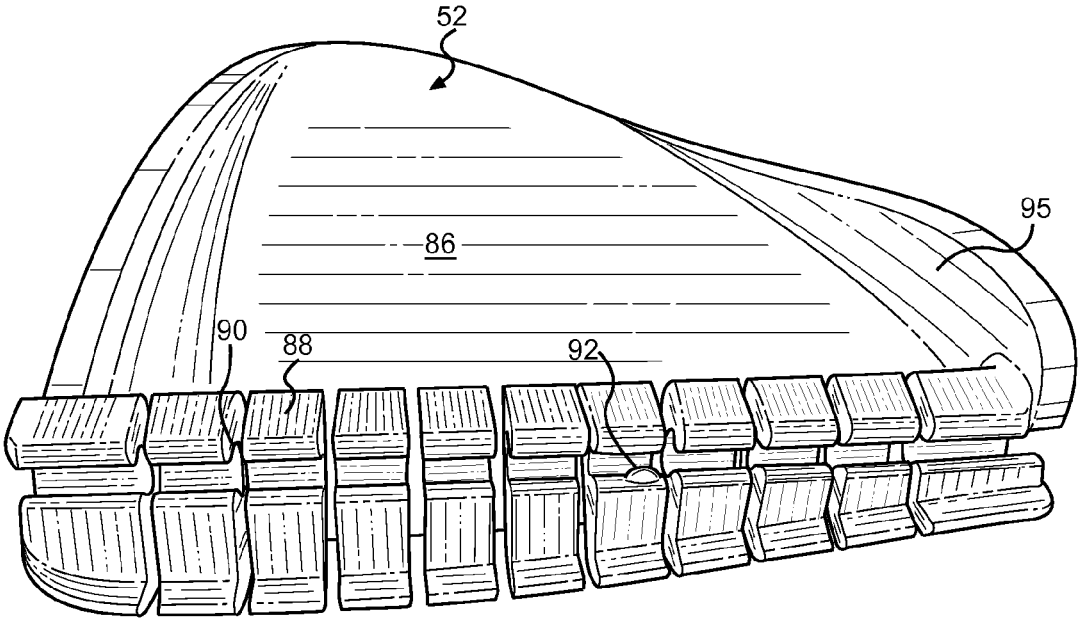
FIG. 9 is a perspective view of a lumbar support pursuant to the invention.
Figure 10:
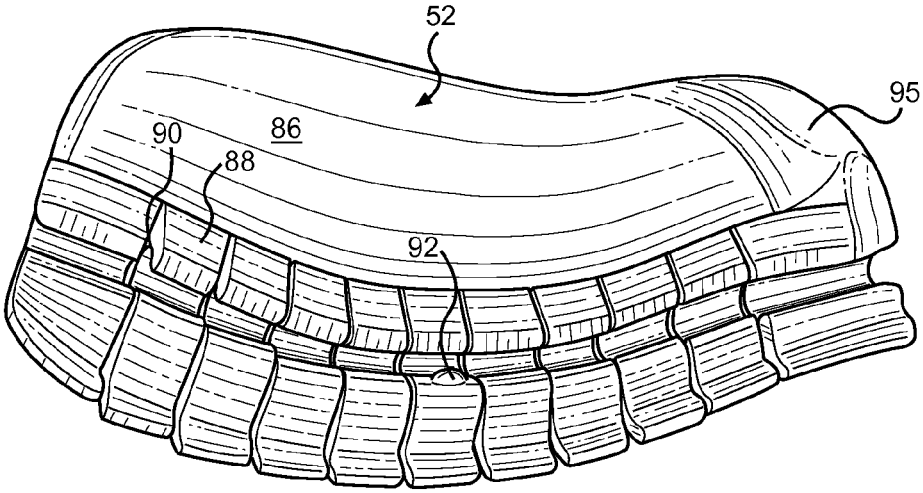
FIG. 10 is a perspective view of the lumbar support of FIG. 9 in a bowed configuration.
Figure 11:
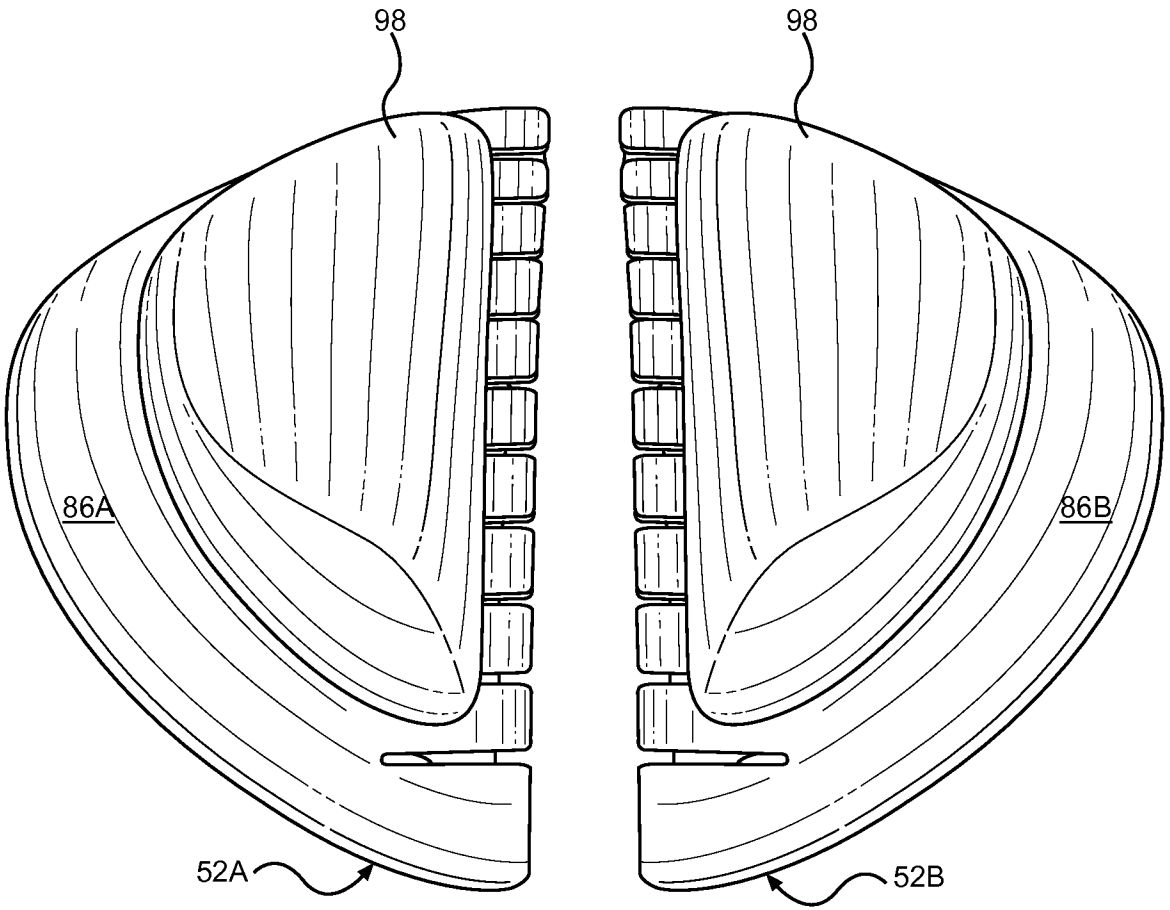
FIG. 11 is a perspective view of left and right lumbar supports with pads coupled thereto.

Looking to FIGS. 7 through 11, it will be appreciated that embodiments of the task chair 10 can provide lumbar support through left and right lumbar support members 52A and 52B. As shown in FIGS. 7 and 8, the pivoting task chair 10 can have a panel of mesh 82 retained in tension by a seat back frame 80. Left and right lumbar support rails 84A and 84B are retained by the left and right side members of the frame 80 to the posterior or reverse side of the supportive panel of mesh 82. The support rails 84A and 84B can be fixed to the frame 80 or integrally formed as a part thereof. In certain embodiments and configurations, the lumbar supports 52A and 52B can impart localized deflection in the panel of mesh 82 thereby to provide increased supportive tension in the panel of mesh 82. Moreover, the lumbar supports 52A and 52B provide direct physical support to the contacting area of the seat occupant's back. As shown in FIG. 11, resiliently compressible pads 98 can be fixed to the body portions 86A and 86B of the lumbar supports 52A and 52B.

Each lumbar support 52A and 52B has a plurality of flexible fingers 88 disposed in series along the edge thereof. The fingers 88 have C-channels 90 formed therein for slidably receiving the respective rails 84A and 84B. The lumbar support members 52A and 52B in this embodiment are formed from a flexible polymeric material with contoured body portions 86 that can have a non-uniform shape, such as the general shape of an abbreviated wing. As seen in FIGS. 9 and 10, each body portion 86 has a handle portion 95 that projects generally perpendicularly to the main body of the body portion 86 for enabling a user to slide the lumbar supports 52A and 52B along the rails 84A and 84B to adjust the location of the lumbar support. As the lumbar supports 52A and 52B are slid along the curved rails 84A and 84B, the flexibility of the material and the fingers 88 permit the lumbar supports 52A and 52B to adapt to the localized shape of the rails 84A and 84B.

Means can be provided for fixing the lumbar supports 52A and 52B in desired locations along the rails 84A and 84B. In the depicted embodiment, the means for fixing the lumbar supports 52A and 52B in desired locations comprise a tooth 92 that projects from one of the fingers 88 in combination with a longitudinally aligned series of indentations 96 in or adjacent to the rails 84A and 84B. The tooth 92 can be selectively engaged with one of the indentations 96 to prevent inadvertent movement of the lumbar supports 52A and 52B relative to the rails 84A and 84B of the back frame 80.

The lumbar supports 52A and 52B present non-symmetrical, contoured surfaces and shapes facing the panel of mesh 82 and the body of the seat occupant. The lumbar supports 52A and 52B can be removed, exchanged for one another, rotated by 180 degrees, and engaged with the opposite rail 84A or 84B as desired. With this, further modification of the lumbar support provided by the lumbar supports 52A and 52B can be achieved.

As noted above, embodiments of the pivoting task chair 10 are contemplated wherein adjustable arm structures 100 are provided. A better understanding of the adjustable arm structure 100 can be had by reference to FIGS. 14 through 21. The arm structure 100 has an arm pad 112 that is supported by a pad retaining member 132 that is in turn retained by an upper arm member 102 with a lower cylindrical portion comprising a sleeve. An inner cylindrical lower arm member 104 is slidably received into the cylindrical portion of the upper arm member 102. Relative play between the upper and lower arm members 102 and 104 is prevented by an O-ring 160 as seen in FIG. 20.

The arm structure 100 could be fastened to the pivoting mechanism housing 26 or elsewhere on the task chair 10 by any effective mechanism. In the depicted embodiment, the arm structure 100 has a lateral base member 106 that retains the arm structure 100 relative to the pivoting mechanism housing 26 by a threaded fastener 115 passed through a fastener aperture 108. Upper and lower bosses 110 are received into corresponding boreholes 117 in the receiving portion of the pivoting mechanism housing 26 to achieve the structure shown, for example, in FIGS. 2E and 21.

An actuation trigger 114 is slidably retained in a trigger channel 134 adjacent to the upper end of the upper arm member 102. Actuation of the actuation trigger 114 permits the selective raising and lowering of the upper arm member 102 relative to the lower arm member 104. A trigger limit member 136 with a portion disposed above the trigger 114 prevents overextension of the actuation trigger 114. First and second column halves 116A and 116B are secured within the lower arm member 104 by a fastener 162 in combination with a D-washer 158 disposed in the bottom end of the first and second column halves 116A and 116B.

Figure 20:
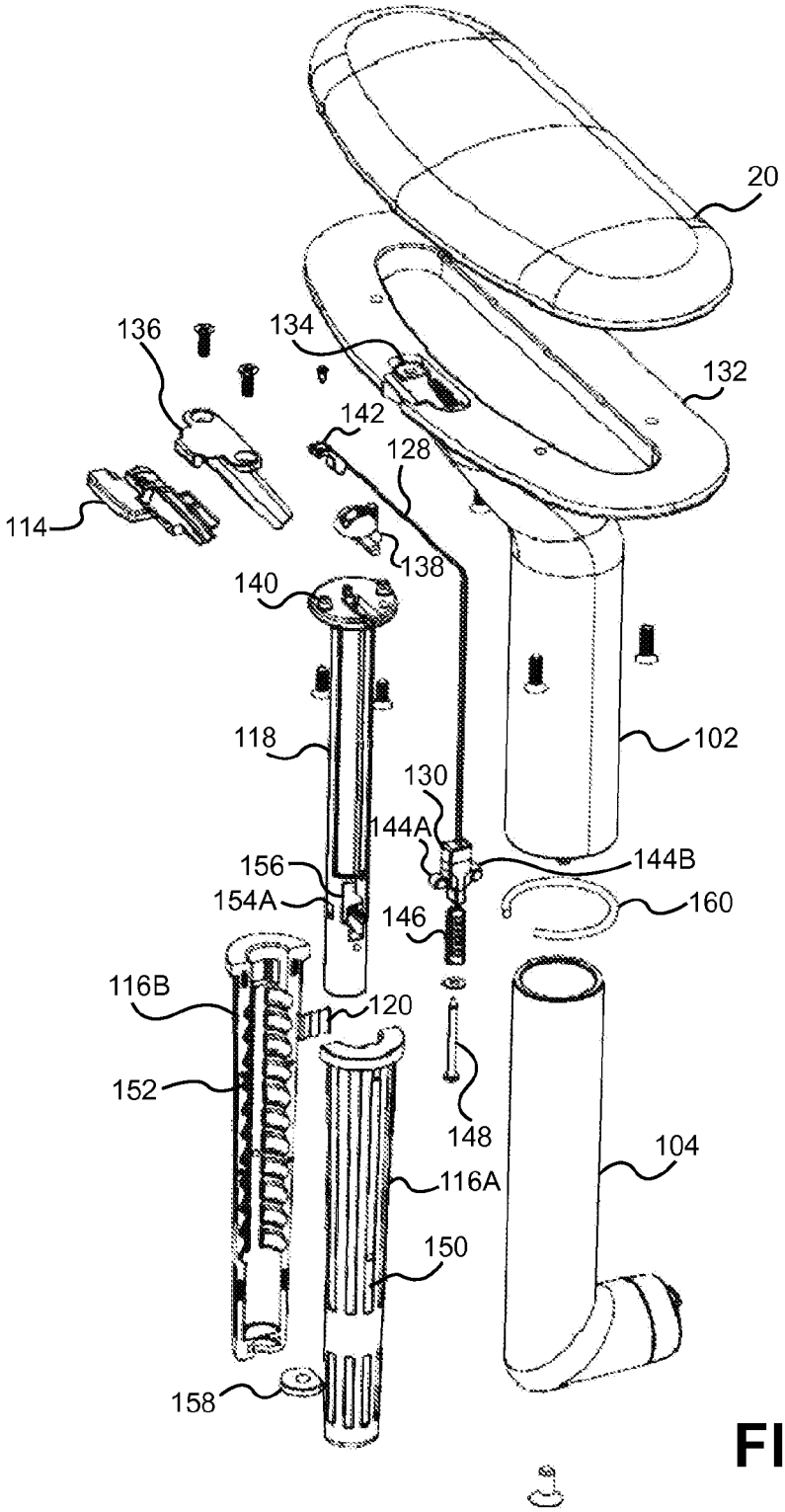
FIG. 20 is an exploded perspective view of the adjustable arm of FIG. 14.
Figure 21:
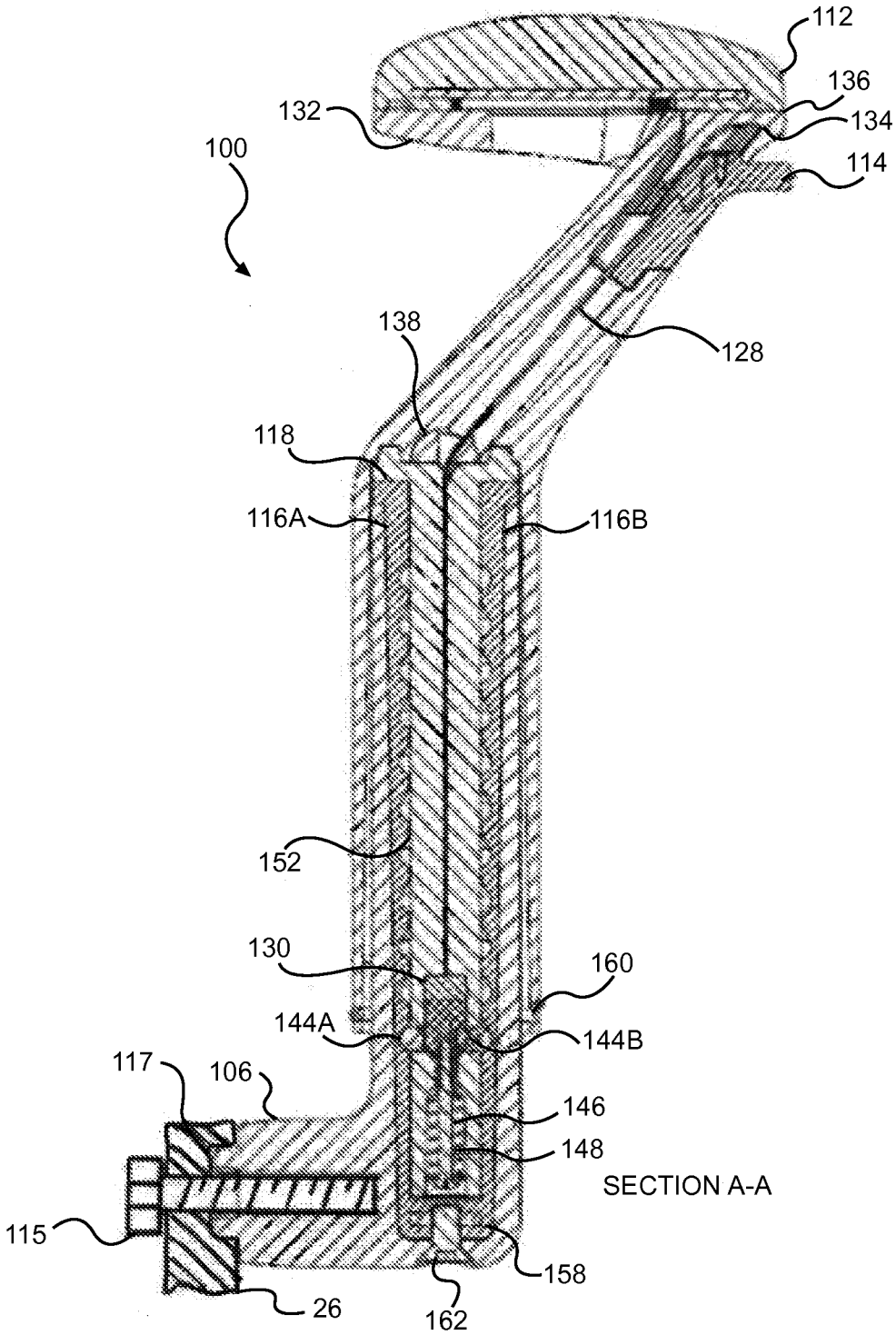
FIG. 21 is a longitudinal cross section of the adjustable arm of FIG. 14.

As seen in FIGS. 20 and 21, the inner wall surface of each column half 116A and 116B has a series of annular lateral channels 152 disposed therein. The outer wall surfaces of the column halves 116A and 116B have a series of longitudinally disposed channels 150 therein. An adjustment rod 118 is received between the column halves 116A and 116B.

The actuation trigger 114 is coupled to a head 142 that is fixed to a first end of a cord 128 that communicates through the adjustment rod 118. A dome member 138 with a contoured through-hole is disposed atop the adjustment rod 118 for guiding the cord 128 and preventing damage thereto. A broadened cord base 130 is secured to the second end of the cord 128. The broadened cord base 130 has an arrow-shaped tip portion, and first and second physically separate locking barrels 144A and 144B are disposed to opposite sides of the tip of the cord base 140 and in alignment with apertures 154A and 154B in the adjustment rod 118. In practice, the barrels 144A and 144B and other components can be installed through an entry aperture 156.

A compression spring 146 is retained on a retaining screw 148, and the retaining screw 148 is received into a distal end of the cord base 140. With this, the cord 128 is biased to the lowered disposition depicted, for example, in FIG. 21.

Under this arrangement, the trigger 114 can be actuated, such as by squeezing, to draw the cord 128 upwardly within the adjustment rod 118 thereby lifting the cord base 140 and permitting the barrels 144A and 144B to move out of engagement with the lateral channels 152 in the column halves 116A and 116B. With this, the upper arm portion 102 can be raised or lowered. The trigger 114 can be released, which causes the cord base 140 to move downwardly to press the barrels 144A and 144B partially through the apertures 154A and 154B into locking engagement with the lateral channels 152. With that, the upper arm portion 102 is fixed against raising and lowering.

Figure 18:
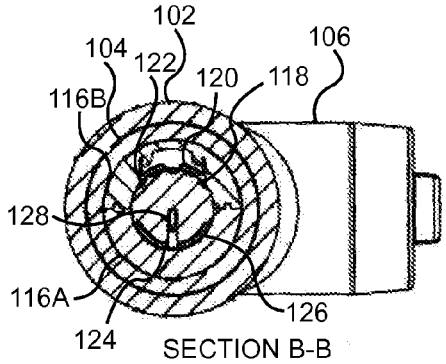
FIG. 18 is a cross-section of the adjustable arm of FIG. 14 taken along the line B-B in FIG. 17.
Figure 19:
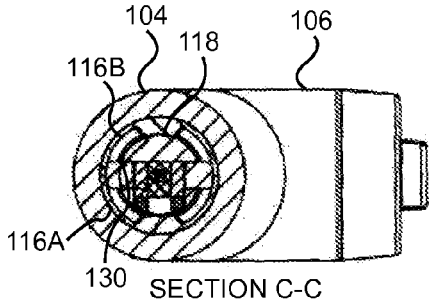
FIG. 19 is a cross-section of the adjustable arm of FIG. 14 taken along the line C-C in FIG. 17.

The upper arm member 102 can be selectively pivoted in relation to the lower arm member 104 through a given degree of angular rotation. As shown in FIG. 18, a spring clip 120 can be retained by the first column half 116A for resiliently engaging longitudinal ridges 122 in the adjustment rod 118. A tooth 124 extends oppositely from the adjustment rod 118 and is received in an arcuate lateral channel 126 in the second column half 116B for permitting pivoting of the upper arm member 102 only through a predetermined degree of rotation. Bosses 140 that project from the adjustment rod 118 into indentations in the upper arm member 102 prevent rotation of the rod 118 relative to the upper arm member 102.

With certain details and embodiments of the pivoting task chair 10 of the present invention disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, these claims shall be construed to cover not only the corresponding structure and material expressly described in this specification but also all equivalents thereof that might be now known or hereafter discovered.

I claim as deserving the protection of Letters Patent:

1. A pivoting task chair comprising:

a chair base;

a pivoting mechanism housing supported by the chair base;

a pivoting mechanism retained by the pivoting mechanism housing;

a seat bottom secured to the pivoting mechanism housing wherein the seat bottom does not pivot in relation to the chair base;

a seat back pivotally coupled to the pivoting mechanism housing by the pivoting mechanism to pivot about a pivot axis in relation to the pivoting mechanism housing and relative to the seat bottom whereby the pivoting mechanism provides resilient resistance to a pivoting of the seat back;

wherein a distance B from a given point on the seat back to a given point of support for a posterior of a seat occupant progressively decreases as the seat back is pivoted backwardly with a measurement $B_1$ taken at a first seat back pivoting position being greater than a measurement $B_2$ at a second, increased seat back pivoting position and the measurement $B_2$ being greater than a measurement $B_1$ at a third, further increased seat back pivoting position; and left and right arm supports with upper ends fixed to the seat back, each at a point of support, and lower ends pivotally coupled to the pivoting mechanism, each at a pivot axis coincident with the pivot axis of the seat back to pivot with the seat back wherein a distance A from the point of support of each arm relative to the seat back to the pivot axis progressively decreases as the seat back is pivoted backwardly with a measurement $A_1$ taken at a first seat back pivoting position being greater than a measurement $A_2$ at a second, increased seat back pivoting position and the measurement $A_2$ being greater than a measurement $A_3$ at a third, further increased seat back pivoting position.

2. The pivoting task chair of claim 1 wherein the chair base has a central cylinder and further comprising a piston arrangement with a base portion retained in the central cylinder of the chair base and a projecting portion that extends beyond the central cylinder of the chair base and further comprising a protective encasing ring received around the projecting portion of the piston of the piston arrangement to sit atop the central cylinder of the chair base to protect the base portion of the piston arrangement.

3. The pivoting task chair of claim 1 further comprising a plurality of casters retained relative to the chair base to render the pivoting task chair mobile.

4. The pivoting task chair of claim 1 wherein the seat bottom comprises a rigid seat pan that underlies a flexible seat insert and a seat cushion secured to overlie the seat insert and the seat pan.

5. The pivoting task chair of claim 4 wherein the seat insert has a depression pattern in the bottom surface thereof corresponding in shape and contour to an upper surface of the seat pan whereby the seat insert and the seat pan are matingly engaged.

6. The pivoting task chair of claim 5 wherein the seat cushion has a depression pattern in the bottom surface thereof corresponding in shape and contour to an upper surface of the seat insert whereby the seat cushion and the seat insert are matingly engaged.

7. The pivoting task chair of claim 4 further comprising a plurality of flexing slots formed adjacent to an anterior edge of the seat pan.

8. The pivoting task chair of claim 7 wherein the flexing slots are disposed in a first, inboard line of abbreviated slots and a second, outboard line of relatively elongated slots communicating adjacent to and generally evenly spaced from the anterior edge of the seat pan.

9. The pivoting task chair of claim 4 wherein the seat insert has an anterior edge portion that extends beyond an anterior edge of the seat pan.

10. The pivoting task chair of claim 1 wherein the seat back comprises a seat back frame and a panel of elastomeric material retained relative to the frame wherein the panel of elastomeric material has a first side for supporting a seat occupant and a second, opposite side and further comprising left and right lumbar support members retained by the seat back frame to the second side of the panel of elastomeric material.

11. The pivoting task chair of claim 10 wherein the left and right lumbar support members are slidably retained relative to the seat back frame whereby a location of lumbar support can be adjusted.

12. The pivoting task chair of claim 11 wherein the left and right lumbar support members are flexible and wherein the lumbar support members are retained relative to the seat back frame by contoured left and right lumbar support rails.

13. A pivoting task chair comprising:

a chair base;

a pivoting mechanism housing supported by the chair base;

a pivoting mechanism retained by the pivoting mechanism housing;

a seat bottom secured to the pivoting mechanism housing wherein the seat bottom does not pivot in relation to the chair base;

a seat back pivotally coupled to the pivoting mechanism housing by the pivoting mechanism to pivot about a pivot axis in relation to the pivoting mechanism housing and relative to the seat bottom whereby the pivoting mechanism provides resilient resistance to a pivoting of the seat back;

wherein a distance B from a given point on the seat back to a given point of support for a posterior of a seat occupant progressively decreases as the seat back is pivoted backwardly with a measurement $B_1$ taken at a first seat back pivoting position being greater than a measurement $B_2$ at a second, increased seat back pivoting position and the measurement $B_2$ being greater than a measurement $B_1$ at a third, further increased seat back pivoting position wherein the seat back comprises a seat back frame and a panel of elastomeric material retained relative to the frame wherein the panel of elastomeric material has a first side for supporting a seat occupant and a second, opposite side;

left and right lumbar support members retained by the seat back frame to the second side of the panel of elastomeric material wherein the left and right lumbar support members are slidably retained relative to the seat back frame whereby a location of lumbar support can be adjusted, wherein the left and right lumbar support members are flexible, wherein the lumbar support members are retained relative to the seat back frame by contoured left and right lumbar support rails, wherein each lumbar support has a plurality of flexible fingers disposed in series along the edge thereof, and wherein the flexible fingers have C-channels formed therein for slidably receiving the respective left and right lumbar support rails.

14. The pivoting task chair of claim 13 further comprising means for fixing the lumbar supports in selected locations along the rails.

15. The pivoting task chair of claim 14 wherein the means for fixing the lumbar supports in selected locations comprises a tooth that projects from each lumbar support in combination with a longitudinally aligned series of indentations retained relative to the seat back frame.

16. The pivoting task chair of claim 13 wherein each lumbar support member has a non-symmetrical, contoured surface and shape and wherein the lumbar support members are nondestructively removable and exchangeable whereby the lumbar support members can be removed, rotated by 180 degrees, and oppositely disposed to provide varied lumbar support.

17. A task chair comprising:

a chair base;

a seat bottom retained relative to the chair base;

a seat back pivotally retained relative to the chair base;

wherein the seat back comprises a seat back frame and a panel of elastomeric material retained relative to the frame wherein the panel of elastomeric material has a first side for supporting a seat occupant and a second, opposite side and further comprising left and right lumbar support members retained by the seat back frame to the second side of the panel of elastomeric material wherein the left and right lumbar support members are slidably retained relative to the seat back frame whereby a location of lumbar support can be adjusted wherein the left and right lumbar support members are flexible, wherein the lumbar support members are retained relative to the seat back frame by contoured left and right lumbar support rails, wherein each lumbar support has a plurality of flexible fingers disposed in series along the edge thereof, and wherein the flexible fingers have C-channels formed therein for slidably receiving the respective left and right lumbar support rails.

18. The task chair of claim 17 further comprising means for fixing the lumbar supports in selected locations along the rails.

19. The task chair of claim 18 wherein the means for fixing the lumbar supports in selected locations comprises a tooth that projects from each lumbar support in combination with a longitudinally aligned series of indentations retained relative to the seat back frame.

20. The task chair of claim 17 wherein each lumbar support member has a non-symmetrical, contoured surface and shape and wherein the lumbar support members are nondestructively removable and exchangeable whereby the lumbar support members can be removed, rotated by 180 degrees, and oppositely disposed to provide varied lumbar support.

* * * * *